United States Patent [19]

Bluem et al.

[11] Patent Number: 4,607,455

[45] Date of Patent: Aug. 26, 1986

[54] ADJUSTABLE GATE FOR DOORWAYS

[75] Inventors: Gary R. Bluem, Wayzata, Minn.; John W. Goodin, Long Beach; Larry G. Hickey, Laguna Hills, both of Calif.

[73] Assignee: North States Industries, Inc., Minneapolis, Minn.

[21] Appl. No.: 656,235

[22] Filed: Oct. 1, 1984

[51] Int. Cl.[4] ..... E06B 3/68

[52] U.S. Cl. ..... 49/55; 49/367; 49/57

[58] Field of Search ..... 49/55, 57, 367; 160/225

[56] References Cited

U.S. PATENT DOCUMENTS

| | | | |
|---|---|---|---|
| 367,162 | 7/1887 | Peterson . | |
| 498,574 | 5/1893 | Ryan . | |
| 604,411 | 5/1898 | Motley . | |
| 865,404 | 9/1907 | Laurent . | |
| 1,238,294 | 8/1917 | Hertz . | |
| 1,465,443 | 8/1923 | Josler | 49/367 X |
| 1,849,024 | 3/1932 | McKee | 160/225 X |
| 2,295,194 | 9/1942 | Atkinson | 160/225 |
| 2,348,561 | 5/1944 | Mutch . | |
| 2,511,372 | 6/1950 | Price . | |
| 2,581,857 | 1/1952 | Harrison . | |
| 2,982,353 | 5/1961 | Luger . | |
| 3,000,063 | 9/1961 | Hoog . | |
| 3,163,205 | 12/1964 | Gottlieb . | |
| 3,216,482 | 11/1965 | Lindholm . | |
| 3,431,966 | 3/1969 | Injeski . | |
| 3,489,201 | 1/1970 | Curry, III et al. . | |
| 3,680,260 | 8/1972 | Bauer . | |
| 3,885,616 | 5/1975 | Berkowitz . | |

OTHER PUBLICATIONS

Promotional Brochure Entitled "Gerry Security Gates".

*Primary Examiner*—Kenneth Downey

*Attorney, Agent, or Firm*—Merchant, Gould, Smith, Edell, Welter & Schmidt

[57] ABSTRACT

A portable, variable width gate for doorways comprising first and second gate sections operably secured together in face to face relation to alter their combined width for filling doorways of varying widths. Actuator means for relatively moving the gate sections including a handle engaging the actuating means in one position and disengaged therefrom in a second position.

22 Claims, 13 Drawing Figures

15
23
29
25
23
28
31
27
13
26
27a
26a
17
17a
19
5
20b
73
12
72
71
5
24
72

19a
21
18
22
18a
16
20
23
11
14
23

FIG. 8
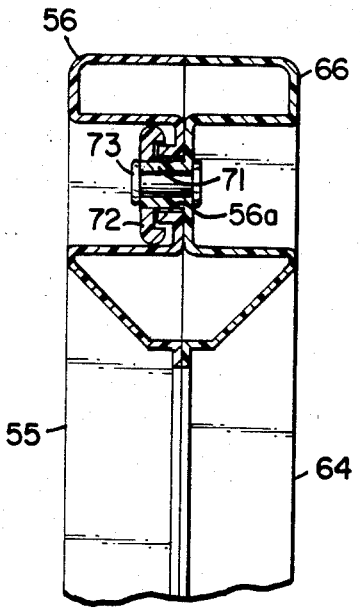
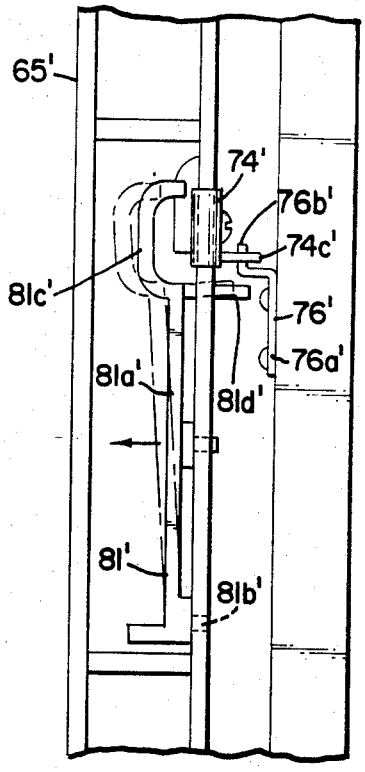
FIG. 9
FIG. 10
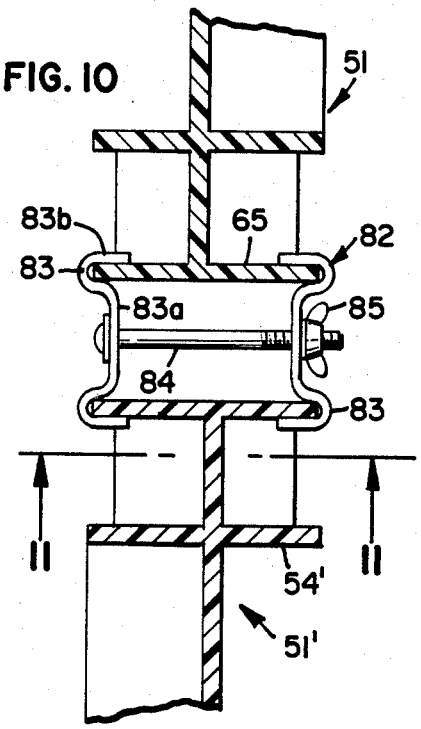
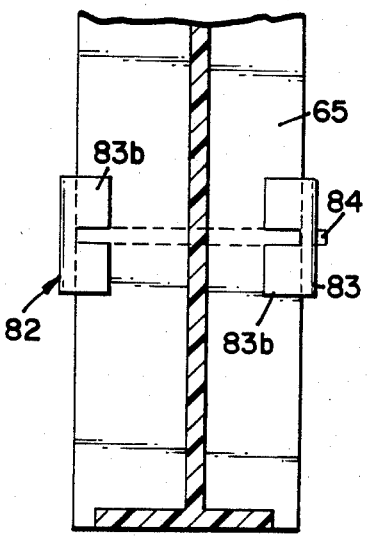
FIG. 11

ADJUSTABLE GATE FOR DOORWAYS

The invention broadly relates to closures and is specifically directed to an adjustable gate suitable for child security, pet control or other similar purposes.

Gate closures provide an important function in the home where doors do not exist to keep children from leaving a safe area, as well as to prevent them from entering a dangerous area (e.g., a stairwell). These devices also find useful application in preventing pets from leaving areas in the house designated for the pet and from entering areas the pet should not go.

A number of gate closures, both portable and adjustable, have found their way to the marketplace, and provide the desired function of blocking a doorway up to a predetermined height while maintaining visibility through the closure.

However, many such gate closures are either extremely difficult to place within a door jamb, require modification to the door jamb, or are not sufficiently adjustable to fit into doors of varying width. In addition, many of the prior art gate closures are difficult to place and remove.

The subject invention is directed to an adjustable gate usable for child security, pet control and other similar purposes which is capable of use in doorways of a wide range of widths, is easily placed or installed, easily removed, and provides a rigid closure which not only protectively restrains the child, but is also constructed to prevent the child from removing it intentionally or inadvertently.

In a first embodiment, the inventive security gate comprises first and second gate sections that are relatively slidable to adjust to the doorway width. The gate sections are held in a fixed position frictionally engaging opposite sides of the door jamb by an inventive mechanism comprising a rotatable handle having a partial gear sector on one of the gate sections, a linear gear section or rack on the other gate section, and means for retaining the rotatable handle in a desired position with the gear teeth in engagement.

This inventive mechanism permits the handle to be rotated to a position where the gear sector teeth are not in engagement with the linear gear teeth, enabling the user to quickly and easily slide the gate sections together or apart to a width which approximates that of the doorway. The handle can thereafter be rotated so that the respective teeth engage, and further rotation causes the gate sections to spread apart slightly further, causing the opposite sides of the gate to firmly and frictionally engage the door jamb. The handle is thereafter retained in this position, preventing removal of the gate.

The adjustable gate of the first embodiment may be both placed and removed in a doorway quickly and easily, and yet provides an extremely rigid enclosure which neither a child not a pet can reach. In addition, due to the unique structural nature of the handle and gear mechanism, a child cannot operate the handle inadvertently or intentionally to remove the gate.

In a second embodiment, the gate comprises two relatively movable gate sections which may also be adjusted relative to the doorway width. However, this device is intended for semi-permanent installation, and one of the sections is provided with removable hinges to be mounted on one side of the door jamb, permitting the gate to swing either outward or inward. The other gate section is provided with a latching hinge, part of which is mounted to the opposite door jamb. This latching structure permits the gate section to be lifted into and out of the gate's closure position. A unique latch cooperates with the hinge structure to lock the gate in the closure position. The latch is operable only by an adult, but is at the same time easily operated to permit the gate to be released and swung to an open position.

BRIEF DESCRIPTION OF THE DRAWINGS

FIG. 3 is a sectional view taken along the line 3—3 of FIG. 2, with the components of the adjustment mechanism in assembled relation;

FIG. 8 is an enlarged fragmentary sectional view taken along the line 8—8 of FIG. 7;

FIG. 9 is an enlarged fragmentary view showing the latching mechanism for the gate;

FIG. 10 is an enlarged fragmentary sectional view taken along the line 10—10 of FIG. 7;

FIG. 11 is a sectional view taken along the line 11—11 of FIG. 10;

DETAILED DESCRIPTION OF THE PREFERRED EMBODIMENTS

Figure 1:
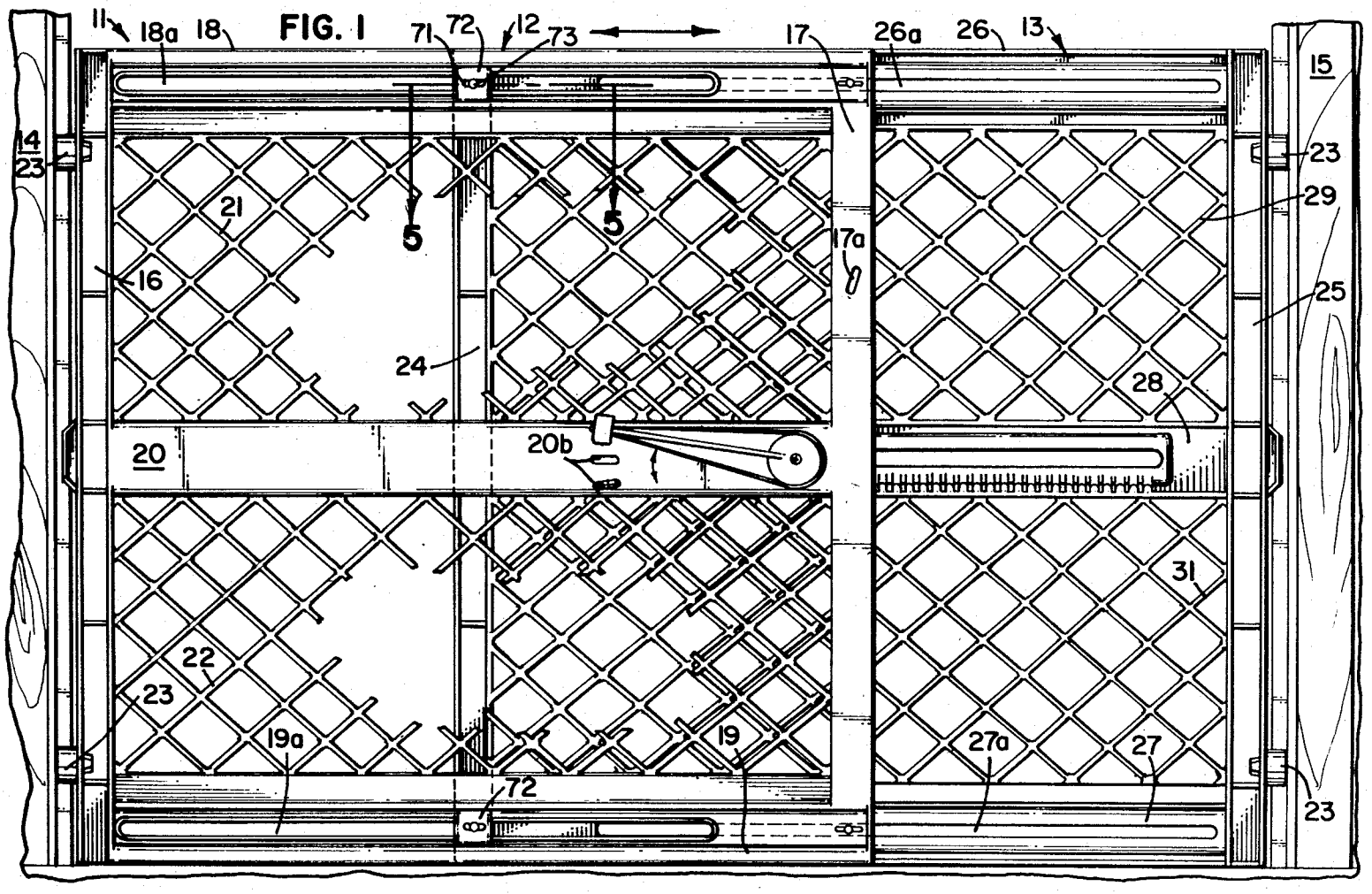
FIG. 1 is a view in side elevation of an adjustable gate embodying the invention.

With initial reference to FIG. 1, an adjustable gate suitable for child security, pet control and other similar purposes is represented generally by the numeral 11. The gate broadly comprises two rectangular sections 12, 13 that are slidably connected (as described below) for adjustment to a desired width to define a closure between two stationary elements. In FIG. 1, the stationary elements comprise opposite sides 14, 15 of a door jamb.

Each of the gate sections 12, 13 is formed from plastic components, the principal of which is a rectangular, integrally molded frame. For the gate section 12, this frame comprises vertical side members 16, 17, and top, bottom and middle cross members 18–20. The sides 16, 17 are both of channel construction, although in the preferred embodiment the side 16 is approximately twice the thickness of the side 17 to accommodate and serve as a stop for the gate section 13. This feature is not shown in the embodiment of FIGS. 1–6, but the structure is similar in the alternative embodiment of FIGS. 7–11, and may be seen in FIGS. 7 and 10 in particular.

The top and bottom cross members 18, 19 are also of channel configuration, although each is formed with a longitudinally extending slot in the face thereof, such slots bearing the reference numerals **18*a*, 19*a***, respectively. The purpose of these slots will be described below.

The middle cross member 20 is of channel configuration, and includes additional structure which will be described below.

A substantially rigid mesh is integrally molded in upper and lower sections 21, 22, the former occupying the space between the sides 16, 17 and upper and middle cross members 18, 20, with the lower mesh section 22 extending between the sides 16, 17 and bottom and middle cross members 19, 20.

A pair of rubber bumpers 23 are connected to the side face of the side 16 by expansion fit to frictionally engage the door jamb 14.

The gate section 13 is similar in construction, including a rectangular frame defined by vertical sides 24, 25 and top, bottom and middle cross members 26–28. Side 25 is approximately twice as thick as side 24 to accommodate and serve as a stop for gate section 12. The top and bottom cross members 26, 27 have similar longitudinal slots **26*a*, 27*a*, respectively. Upper and lower mesh sections 29, 31 are integrally molded between the frame members 24–28 in the same manner as gate section 12. Similarly, rubber bumpers 23 are secured to the vertical side 25 to frictionally engage the opposite door jamb 15**.

The longitudinal slots **18*a*, 26*a* are disposed in longitudinal alignment as well as face-to-face registration, as best shown in FIG. 1. With additional reference to FIG. 5, at the juncture of the side and top cross members 24, 26, a projection 32 is molded which is sized to fit into the slot 18*a* of gate section 12 and to slide therein. An elongated stud 33 extends forwardly from its outer surface, and a square button 34 is formed with an elongated recess to frictionally fit over the stud 33. The button 34 is sized to slide within the recess of the channel-shaped cross section of the top cross member 18, and the projection 32 slides in the longitudinal slot 18*a*, thus permitting guided sliding movement between the gate sections 12, 13**.

Similar components are provided at the lower end of side member 24 (see square button 35 in FIG. 1), as well as on the upper and lower ends of vertical side member 17, although the associated square buttons are located on the opposite side of the gate 11 as viewed in FIG. 1 and cannot be seen.

As described to this point, the gate sections 12, 13 may slide relative to one another so that the gate 11 has a variable width to adjust to the space between the door jambs 14, 15.

Figure 2:
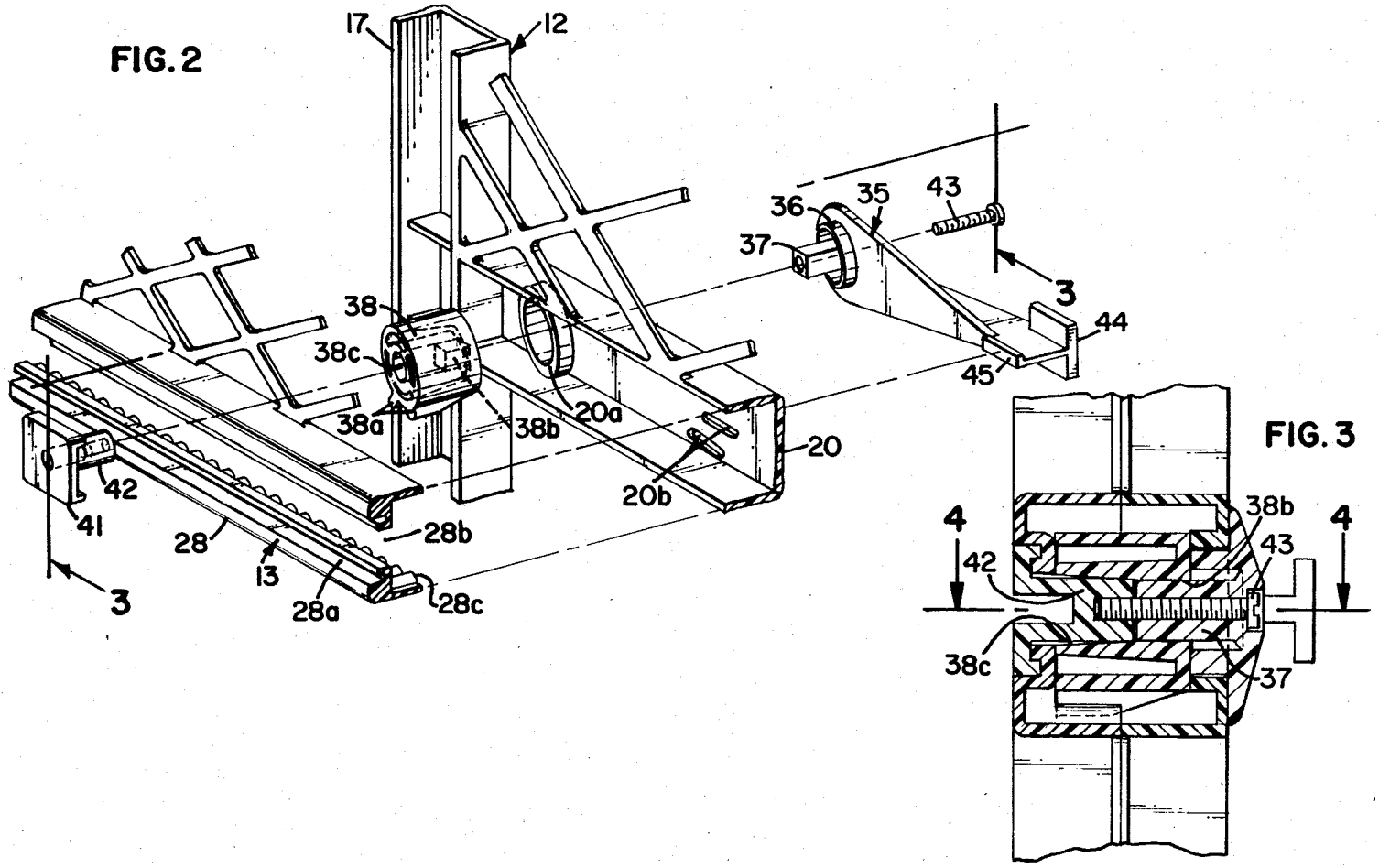
FIG. 2 is an enlarged exploded perspective view of the adjustment mechanism for the adjustable gate.

FIGS. 1–4 and 6 disclose structure for locking the gate sections 12, 13 into a predetermined relative position to hold the gate 11 into frictional engagement between the jambs 14, 15. With reference to FIG. 2, the inner face of middle cross member 20 (gate section 12) is formed with a cylindrical boss **20*a* just adjacent to the vertical side member 17. An adjustment handle 35 of irregular configuration, and which is integrally molded from plastic in the preferred embodiment, has a rotatable hub 36 which fits into the boss 20*a* for guided rotation therein. A square stud 37 projects forwardly from the center and beyond the hub 36**.

A circular gear member 38 having only two gear teeth **38*a* has a square recess 38*b* sized to fit over the square stud 37, and a circular bore 38*c* longitudinally aligned with the recess 38*b***.

Figure 4:
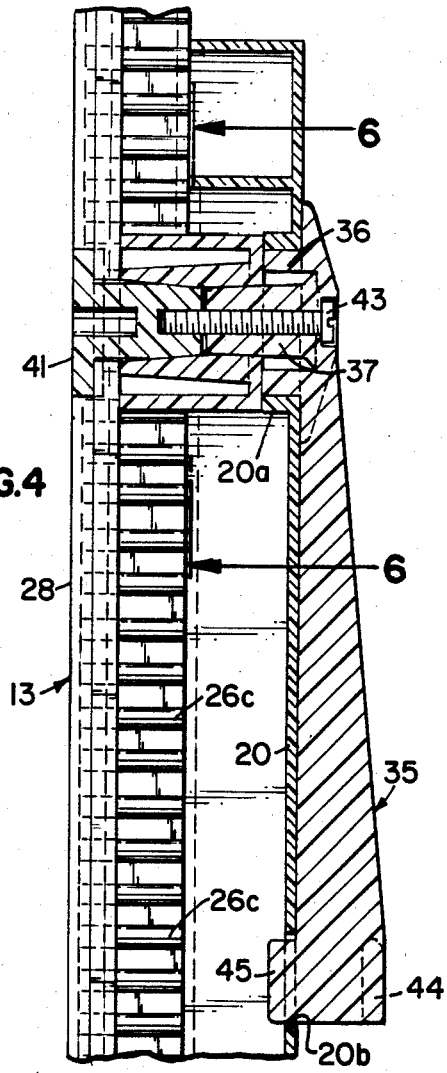
FIG. 4 is a sectional view taken along the line 4—4 of FIG. 3.
Figure 6:
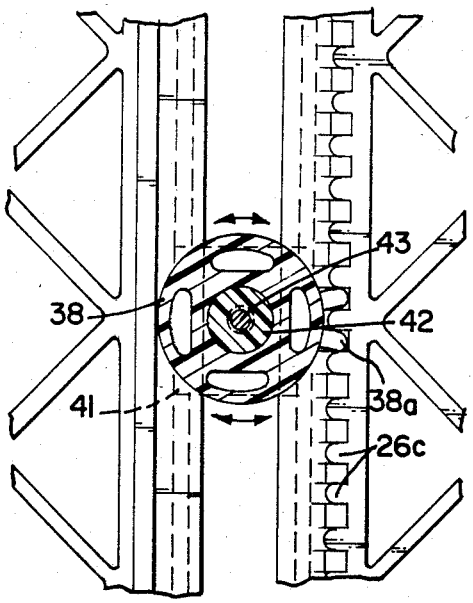
FIG. 6 is a fragmentary sectional view taken along the line 6—6 of FIG. 4.
Figure 5:
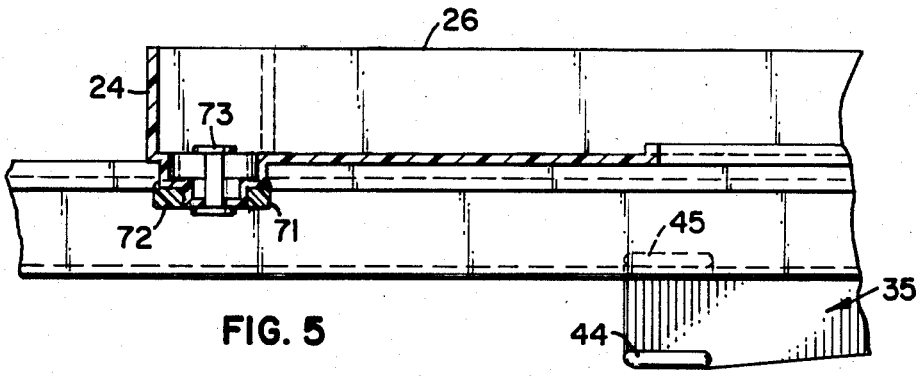
FIG. 5 is a fragmentary sectional view taken along the line 5—5 of FIG. 1.

With reference to FIGS. 2, 4 and 6, the middle cross member 28 of gate section 13 is channel-shaped in cross section, but is formed with a longitudinal recess **28*a* in which a longitudinal slot 28*b* is formed. Extending along the bottom edge of the slot 28*b* and facing toward the gear member 38 is a linear section of gear teeth 28*c* configured to cooperate with the gear teeth 38*a* of gear member 38**.

With additional reference to FIG. 3, a square button 41 is sized to fit within the recess **28*a* and includes a tapered stud 42 that projects through the slot 28*b*. As best shown in FIG. 3, the tapered stud 42 is received into the circular bore 38*c* of the gear member 38, and due to its tapered surface can be drawn into a wedging relationship with the bore 38*c*. A screw 43 passes through a bolt hole within the stud 37 and into a threaded bore within the tapered stud 42 to draw the two tightly together. As such, rotation of the handle 35 causes similar rotation of the gear member 38. If the gear teeth 38*a* are meshed with the gear teeth 28*c*, rotation of the handle 35 causes the gate section 13 to move relative to the gate section 12. However, if the gear teeth 38*a* do not mesh with the gear teeth 28*c*, rotation of the handle does not have any effect, and the gate sections 12, 13 can slide relatively to one another without corresponding movement of the handle 35**.

Handle 35 has a radially extending handle portion terminating in a grasping tab 44. Immediately below the tab 44 is a foot 45 configured to fit into one of three slots **20*b* in the frontal face of the middle cross member 20 of gate section 12. The foot 45 may be pressed into any of the slots 19*b* to hold the handle 35 in a selected fixed position, and removal of the handle 35 is intentionally difficult because of the configuration of the foot 45**.

With reference to FIG. 1, an additional slot **17*a* for the foot 45 is formed in vertical side 17 to hold the handle 35 in a nonoperative position (i.e., one in which the teeth 38*a* do not engage the teeth 28*c***).

In operation, the gate 11 is carried to the doorway or similar opening in which it is to be placed. The handle 35 is either left with the foot 45 in slot **17*a*, or is rotated until the gear teeth 38*a* do not mesh with the gear teeth 28*c*. In this position, the gate sections 12, 13 can slide relatively to either decrease or increase the overall width of the gate 11. With the gate sections 12, 13 moved so that the overall width of the gate 11 is slightly less than the door opening, the handle 35 is rotated (counterclockwise as viewed in FIG. 1) until the teeth 38*a*, 28*c* intermesh. At this point, further counterclockwise rotation of the handle 35 will cause the gate sections 12, 13 to spread apart, increasing the overall width of the gate 11, and the four rubber bumpers 23 will respectively engage the door jambs 14, 15. At this point, the handle 35 is moved counterclockwise slightly further until the foot 45 is in alignment with and pressed into one of the slots 20*b*. There is strong frictional engagement between the rubber bumpers 23 and door jambs 14, 15, and the gate sections 12, 13 are locked into a rigid position to hold the gate 11 in place. Because of its overall construction, the gate 11** is quite rigid in this locked position and cannot be moved by a child or pet.

The handle 35 is constructed to have a degree of torsional flexibility, and the foot 45 may be removed from the associated slot **20*b* by grasping the tab 44 and twisting the handle arm until the foot 45 is no longer retained by the associated slot 20*b*. This enables the handle 35 to be rotated to release the teeth 38*a* from the teeth 28*c*, and the respective gate sections 12, 13 can be retracted from engagement with the door jambs 14, 15 for removal of the gate 11**.

For storage purposes, the gate sections 12, 13 can slide to and be held in a fully retracted position, with the vertical sides 16, 24 and 17, 25 in abutting relation.

Figures 7, 12, 13:
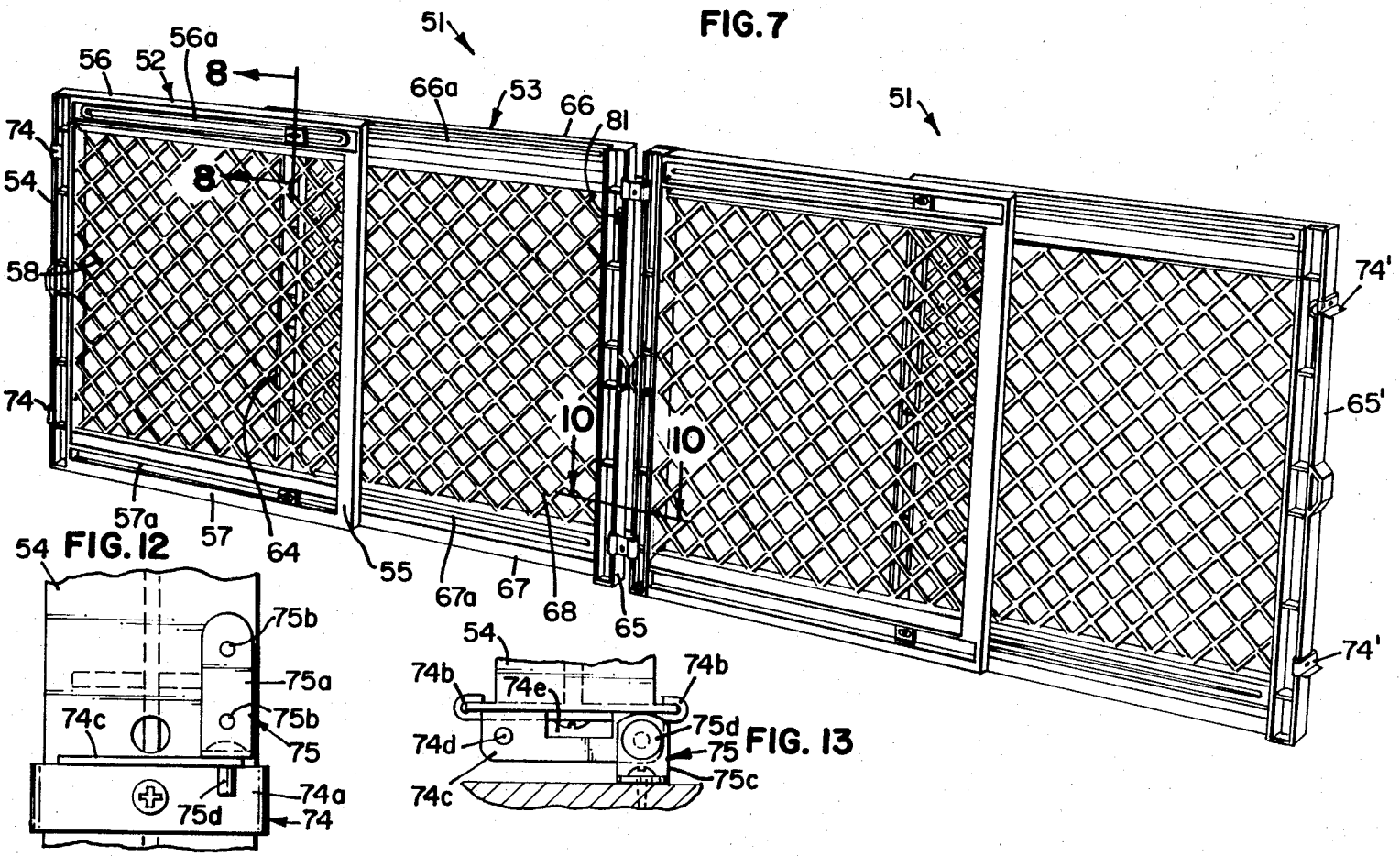
FIG. 7 is a perspective view of an alternative embodiment of the inventive adjustable gate.
FIG. 12 is an enlarged fragmentary view in side elevation of a hinge for the gate FIG. 7.
FIG. 13 is an enlarged fragmentary view in top plan view of the gate hinge.

An alternative embodiment of the inventive gate is shown in FIGS. 7–11. With reference to FIG. 7, two of the alternative embodiments are represented generally by the numerals 51, 51'. Gates 51, 51' are virtually identical, with the exception of structure described below, and a specific description of gate 51 will be exemplary of both.

Gate 51 comprises gate sections 52, 53 which are identical except as noted below. Gate section 52 is formed from vertical side members 54, 55 and top and bottom cross members 56, 57 which are integrally joined to define a rectangular frame. A substantially rigid mesh section 58 is integrally molded to the members 54–57 to fill the rectangular frame space.

Each of the members 54–57 is of channel-shaped cross section for strength and rigidity. Vertical side 54 has a transverse dimension or thickness which is generally twice that of the members 55–57, which permits it to accommodate and serve as a stop for the associated gate section 53.

The top cross member 56 has a longitudinally extending slot **56*a* formed in its face, and similar slot 57*a* is formed in the bottom cross member 57**.

Gate section 63 has vertical side members 64, 65 and top and bottom cross members 66, 67 with a substantially rigid mesh section 68 integrally molded therewith. Top cross member 66 is formed with a longitudinally extending slot **66*a* which is disposed in longitudinal alignment as well as face-to-face registration with the slot 56*a*. Similarly, a slot 67*a* in the bottom cross member 67 is disposed in longitudinal alignment and face-to-face registration with the longitudinal slot 57*a***.

With reference to FIG. 8, at the juncture of the side and top cross members 64, 66, a projection 71 is molded which is sized to fit into the slot **56*a* in gate section 52 and to slide therein. A square button 72 is formed with an aperture sized and disposed to frictionally fit over the projection 71. (The structure is virtually the same as that shown in FIG. 5 of the first embodiment.) The button 72 is sized to slide within the recess of the channel-shaped cross section of the top cross member 56, and the projection 71 slides in the longitudinal slot 56*a*, thus permitting guided sliding movement between the gate sections 52, 53. A rivet 73** secures these components together.

Similar structural components are provided at the juncture of side member 64 and lower cross member 67 (see square button 74 in FIG. 7), as well as on the upper and lower ends of vertical side member 55, although the associated square buttons are located on the opposite side of the gate 51.

As described, the gate sections 52, 53 may slide relative to one another about these four points, so that the gate 51 has a variable width.

A gate hinge 74 is secured to the vertical side member 54 at upper and lower points, and in mirror relation. With reference to FIGS. 12 and 13, the gate hinge 74 is shown to comprise a metal stamping comprising a body strap **74*a* the ends of which are bent inwardly to define hooks 74*b* which receive the edge flange of vertical side member 54. A flange or shelf 74*c* projects laterally outward from the body strap 74*a*, and includes circular apertures 74*d* at each end (only one of which is shown in FIG. 13) and a rectangular aperture 74*e*** which is disposed slightly off center.

A casement hinge 75 is constructed to pivotally cooperate with the gate hinge 74. Casement hinge 75 comprises an upright body strap **75*a* having upper and lower screw holes 75*b*, and an inwardly projecting tab 75*c* that carries a pivot pin 75*d***.

The strap **75*a* is screwed to a door jamb or similar support as shown in FIG. 13, and the pivot pin 75*d* is received in one of the two apertures, 74*d*, permitting the gate 51** to swing inward or outward as desired.

Gate 51' has structural components identical to those of the gate 51, such components bearing the same reference numerals with the addition of a prime symbol.

Vertical side member 65' has gate hinges 74' secured at upper and lower points as shown in FIG. 7. Each of the gate hinges 74' is constructed to cooperate with a locking tab 76', both of which are secured to the door jamb or other supporting structure disposed in opposition to the door jamb to which the casement hinges 75 are secured.

FIG. 9 discloses the upper gate hinge 74' and locking tab 76'. The locking tab 76' comprises a body strap **76*a'* with an offset tab 76*b'* sized and disposed to be received in the rectangular aperture 74*e'* of gate hinge 74'. In this regard, the gate 51' is lifted so that the laterally projecting flanges 74*c'* of each gate hinge 74' drop onto the upwardly projecting tabs 76*b'* of the respective locking tabs 76'. Together with the gate hinges 74 and casement hinges 75, the gates 51, 51' are thus supported from each door jamb in gate fashion, permitting the unit to swing to a closed latch position, as well as permitting lifting of the unit from the locking tab 76' to swing the gates 51, 51'** open.

To insure that a child cannot lift gate 51' to release it from the locking tabs 76', a latch bearing the general reference numeral 81' is provided. With reference to FIG. 9, the latch 81' is disposed in the channel of vertical side member 65', comprising an elongated thin body **81*a'* the lower end of which is secured to the vertical member 65' by a rivet 81*b'*** or similar structure.

A curved handle **81*c'* sized to be engaged by the finger of an adult is disposed at the upper end of the body 81*a'*. A latching tab 81*d'* extends laterally outward from the bottom of handle 81*c'* and projects through an opening in the side of vertical side member 65'**.

As shown in FIG. 9, the body **81*a'* is flexible and resilient (being preferably formed from heavy plastic), permitting the latching tab 81*d'* to be extended and retracted. In the extended position, which is represented by solid lines in FIG. 9, the latching tab 81' underlies the locking tab 76' when the gate is latched, and prevents the gate from being lifted upwardly from the locking tab 76'. However, when the handle 81*c'* is grasped to flex the latch 81' inwardly, the latching tab 81*d'* is retracted to a position represented by the phantom lines in FIG. 9, establishing clearance with the locking tab 76' and permitting the gate to be lifted from the respective locking tabs 76'** and swung open.

The vertical side member 65 of gate 51 has an identical latch 81 as shown in FIG. 7, and it will be appreciated that gate hinges 74 may be similarly mounted to the vertical side member 65 if but a single gate section 51 is used. Thus, the gate pivot hinges and latching structure operate identically for either a single gate or a double gate.

A single gate 51 or 51' is obviously usable for a door jamb of conventional size. The gate sections 52, 53 are dimensioned and relatively slidable to fit into a variety of door jamb openings typically of single door size. However, it is sometimes desirable to have an adjustable security gate in a door jamb opening or similar area which is much wider than normal, and to that end, means are provided for simply and easily joining the gates 51, 51' together.

With reference to FIGS. 7, 10 and 11, a gate connector is represented generally by the numeral 82, and is shown to comprise two identical brackets 83 joined by a bolt 84 and thumb screw 85. Each of the brackets 83 comprises a body strap 83*a* the ends of which are bent to define hooks 83*b*. The hooks 83*b* are sized to receive and grasp a flange of the adjacent vertical side members 65 and 54'. The bolt 84 extends through the opposed body straps 83 and is secured tightly by the thumb screw 85 as shown in FIG. 10, thus holding adjacent edges of the gates 51, 51' together. As shown in FIG. 7, upper and lower gate connectors 82 are used in the preferred embodiment.

In installing the double gates 51, 51', the gate connectors 82 are first assembled and mounted to secure the gates 51, 51' together. The casement hinges 75 are thereafter located on one of the door jambs and mounted permanently as shown in FIGS. 12 and 13. The correct aperture 74*d* for pivot pin 75*d* must be chosen to permit gate swing in the desired direction.

Locking tabs 76' must thereafter be mounted on the opposite door jam in a proper position to receive the gate hinges 74'.

With the hinge hardware installed, the gate can be closed and latched as described above to close off the doorway, and opened by releasing the latch 81'.

What is claimed is:

1. A portable, variable width gate for doorways and the like, comprising:

first and second gate sections of predetermined height and width, each comprising a rectangular external frame defined by top and bottom substantially horizontal cross members and substantially vertical side members;

a substantially horizontal middle cross member disposed between the top and bottom members and interconnecting the side members;

a mesh section interconnecting the respective frame members;

means for connecting the gate sections for free relative sliding movement between a first position of minimum gate width and a second position of maximum gate width;

and operator means for fixing the relative positions of the first and second gate sections at a predetermined width comprising:

handle drive means carried by the middle cross member of one of said gate sections for movement through first and second ranges of positions;

drivable means carried by the middle cross member of the other of said gate sections;

the handle drive means comprising a first operative portion engageable with the drivable means and cooperable therewith to effective relative movement between the first and second gate sections when the handle drive means is moved through the first position range, and a second operative portion incapable of engaging the drivable means when the handle drive means is moved through said second position range;

and means for selectively fixing the handle drive means in a plurality of discrete positions within said first position range.

2. The gate defined by claim 1, which further comprises second means separate and remotely disposed from the first named selective fixing means for fixing the handle drive means in a discrete position within said second position range.

3. The gate defined by claim 1, wherein the rectangular frame and mesh sections of each gate section are integrally formed.

4. The device defined by claim 1, wherein the handle drive means comprises a handle member rotatably carried by said one gate section through 360 degrees of movement, said first and second position ranges each occupying a part of said 360 degrees of movement.

5. The gate defined by claim 1, wherein:

the handle drive means further comprises a hub rotatable with said handle member having a circumferential surface;

the first operative portion comprises a gear sector on the hub having geared teeth occupying less than the entirety of the circumferential surface;

the second operative position comprises a toothless sector occupying the remainder of said circumferential surface;

and the drivable means comprises a linear section of gear teeth constructed and sized to drivably cooperate with the gear teeth of said gear section.

6. The gate defined by claim 5, wherein:

the handle member comprises an elongated handle portion extending radially outward from said hub, the handle portion having a laterally projecting foot member;

and the means for selectively fixing the handle drive means comprises a plurality of recesses formed in the middle cross member of said one gate section and respectively positioned and constructed to receive and retain the projecting foot member.

7. The gate defined by claim 6, wherein the recesses are disposed arcuately to receive the foot member as it rotates through an arcuate path.

8. The gate defined by claim 6, wherein the second means for fixing the handle drive means comprises at least one recess formed in one of the vertical sides of said one gate section.

9. The gate defined by claim 5, wherein:

each of said middle cross members is of channel shaped cross section, with said channels disposed in opposition to define an enclosed space therebetween;

the hub of said handle drive means is rotatably disposed within said enclosed space;

the handle member of said handle drive means is rotatably carried externally of said enclosed space;

and the linear section of gear teeth is disposed within said enclosed space.

10. The gate defined by claim 5, wherein:

the hub of said handle drive means comprises a central bore at least part of which is of rectangular configuration; and the handle member comprises a rectangular shank sized for insertion into the rectangular bore for drivable engagement therewith.

11. The gate defined by claim 10, wherein:

the central bore of said hub further comprises a portion of circular configuration;

the handle drive means further comprises a tapered stud insertable into the circular portion of said bore in axial opposition to the rectangular shank;

and further comprising fastening means for securing the square shank to the tapered stud.

12. The gate defined by claim 1, which further comprises:

a second gate of similar construction to the first named gate, the first and second gates having gate sections with adjacently disposed side members;

and connection means for releasably connecting said adjacent side members together to define a double gate of increased effective width.

13. The gate defined by claim 1, wherein the top member of one of said sections is formed with a slot therein, and further comprising a guide member carried by the top member of the other of said gate sections, the guide member being disposed within said slot and constructed and sized to retainably slide therein.

14. The gate defined by claim 1, wherein the top member of each of said gate sections is formed with a slot therein, the slots being disposed in at least partial registration, and further comprising a guide member carried by each top member, each guide member being disposed within the slot of the opposite gate section and constructed and sized to retainably slide therein.

15. The gate defined by claim 1, wherein the bottom member of one of said gate sections is formed with a slot therein, and further comprising a guide member carried by the bottom member of the other of said gate sections, the guide member being disposed within said slot and constructed and sized to retainably slide therein.

16. The gate defined by claim 1, wherein the bottom member of each of said gate sections is formed with a slot therein, the slots being disposed in at least partial registration, and further comprising a guide member carried by each bottom member, each guide member being disposed within the slot of the opposite gate section and constructed and sized to retainably slide therein.

17. The gate defined by claim 1, wherein one of the side members of one of the gate sections is substantially twice as thick as the other side member to act as a stop to movement of the other gate section.

18. The gate defined by claim 1, wherein one of the side members of each of the gate sections is substantially twice as thick as the other side member to act as a stop to movement of the other gate section.

19. The gate defined by claim 10, wherein:

the first latching means comprises a laterally projecting flange member having an aperture formed therein; and the second latching means comprises a vertically oriented body having an offset tab projecting upwardly therefrom and sized to receive the flange member with the aperture fitting thereover.

20. The gate defined by claim 19, wherein the third latching means comprises a handle having a retention member movable between said first and second positions, the retention member being disposed below and in locking engagement with the offset tab in said first position, and said retention member being retractable to said second position to avoid said blocking engagement.

21. The gate defined by claim 20, wherein the handle is resiliently flexible to permit movement of the retention member between the first and second positions.

22. A variable width gate for doorways and the like defined by opposed supports, comprising:

first and second gate sections each having a predetermined width defined by opposite sides;

means for connecting the gate sections for free relative sliding movement between a first position of minimum gate width and a second position of maximum gate width;

hinge means disposed on one side of one of the gate sections for pivotally connecting the gate to one of the opposed doorway supports;

first latching means disposed on the opposite side of the other of said gate sections;

second latching means adapted for mounting on the other of said opposed doorway supports;

one of said first and second latching means comprising a first latching member with a projecting tab, and the other of said first and second latching means comprising a second latching member with an aperture constructed to receive the projecting tab;

and third latching means movable between first and second positions for preventing the first latching means from being removed from the second latching means in said first position, and for permitting the first latching means to be removed from the second latching means in said second position, the third latching means being constructed and disposed to retain the projecting tab in said aperture when the third latching means is in said first position.

* * * * *